United States Patent [19]

Lewis

[11] Patent Number: 4,556,095

[45] Date of Patent: Dec. 3, 1985

[54] ARCUATE BLIND

[75] Inventor: Harold M. Lewis, Montgomery, Pa.

[73] Assignee: Marathon Manufacturing Company, Mongtomery, Pa.

[21] Appl. No.: 626,302

[22] Filed: Jun. 29, 1984

[51] Int. Cl.[4] ..... E06B 9/26

[52] U.S. Cl. ..... 160/166 R; 160/172; 160/174; 160/178 R

[58] Field of Search ..... 160/172, 88, 134, 174, 160/107; 49/74, 90

[56] References Cited

U.S. PATENT DOCUMENTS

| | | | |
|---|---|---|---|
| 1,397,215 | 11/1921 | Hough | 160/88 |
| 1,646,493 | 10/1927 | Russell | 160/88 |
| 1,810,899 | 6/1931 | Boehm | 160/88 |
| 2,181,897 | 12/1939 | Kapp | 160/172 |
| 2,216,414 | 10/1940 | Kapp | 160/172 |
| 2,341,023 | 2/1944 | Davis | 160/172 X |
| 2,517,281 | 8/1950 | Brown | 160/134 X |
| 3,818,969 | 6/1974 | Debs | 160/172 X |

FOREIGN PATENT DOCUMENTS

| | | | |
|---|---|---|---|
| 699431 | 11/1953 | United Kingdom | 160/172 |

*Primary Examiner*—Ramon S. Britts
*Assistant Examiner*—David M. Purol
*Attorney, Agent, or Firm*—Robert K. Youtie

[57] ABSTRACT

A venetian blind including end rails and slats all extending in parallelism with each other and lying in a cylindrical or arcuate surface, and a stay extending through the slats and between the end rails to maintain the venetian blind in its arcuate configuration.

9 Claims, 5 Drawing Figures

ARCUATE BLIND

BACKGROUND OF THE INVENTION

There has recently come into vogue the construction of curved building windows, as well as curved and transparent building walls and overhead structures. It has been found desirable to utilize conformably curved venetian blind type partitions in association with such building structures. While venetian blinds have a long and innovative history, they have not heretofore been capable of assuming a desired arcuate configuration while remaining subject to controlled tilting. Applicant is aware of the prior art listed below:

| U.S. PAT. NO. | PATENTEE |
|---|---|
| 1,893,659 | STACK |
| 2,334,482 | DAVIS |
| 2,341,023 | DAVIS |

While the above cited prior art concerns arcuate partitions, it does not suggest applicant's essential combination of venetian blind with arcuate stays maintaining the curved configuration.

SUMMARY OF THE INVENTION

It is, therefore, an important object of the present invention to provide a venetian blind construction which is uniquely well adapted for installation in arcuately conforming relation with respect to curved building windows, walls and roofs, such as for glass enclosed walkways, swimming pool covers, etc.

It is a further object of the present invention to provide a venetian blind construction of the type described which is capable of quick and easy installation to assume the arcuate contours of glazing, and the like, while remaining operable to open and close the tiltable slats by the usual means, such as control cords or wands to achieve desired privacy, light, ventilation, etc.

It is still a further object of the present invention to provide an arcuate venetian blind construction having the advantageous characteristics mentioned in the preceding paragraphs, wherein flexible, slat supporting ladders extend between parallel end rails and are provided with elongate stays extending between the rails and through the slats, the stays being arcuately configured and causing the venetian blind to assume the desired arcuate configuration.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figures 1, 3:
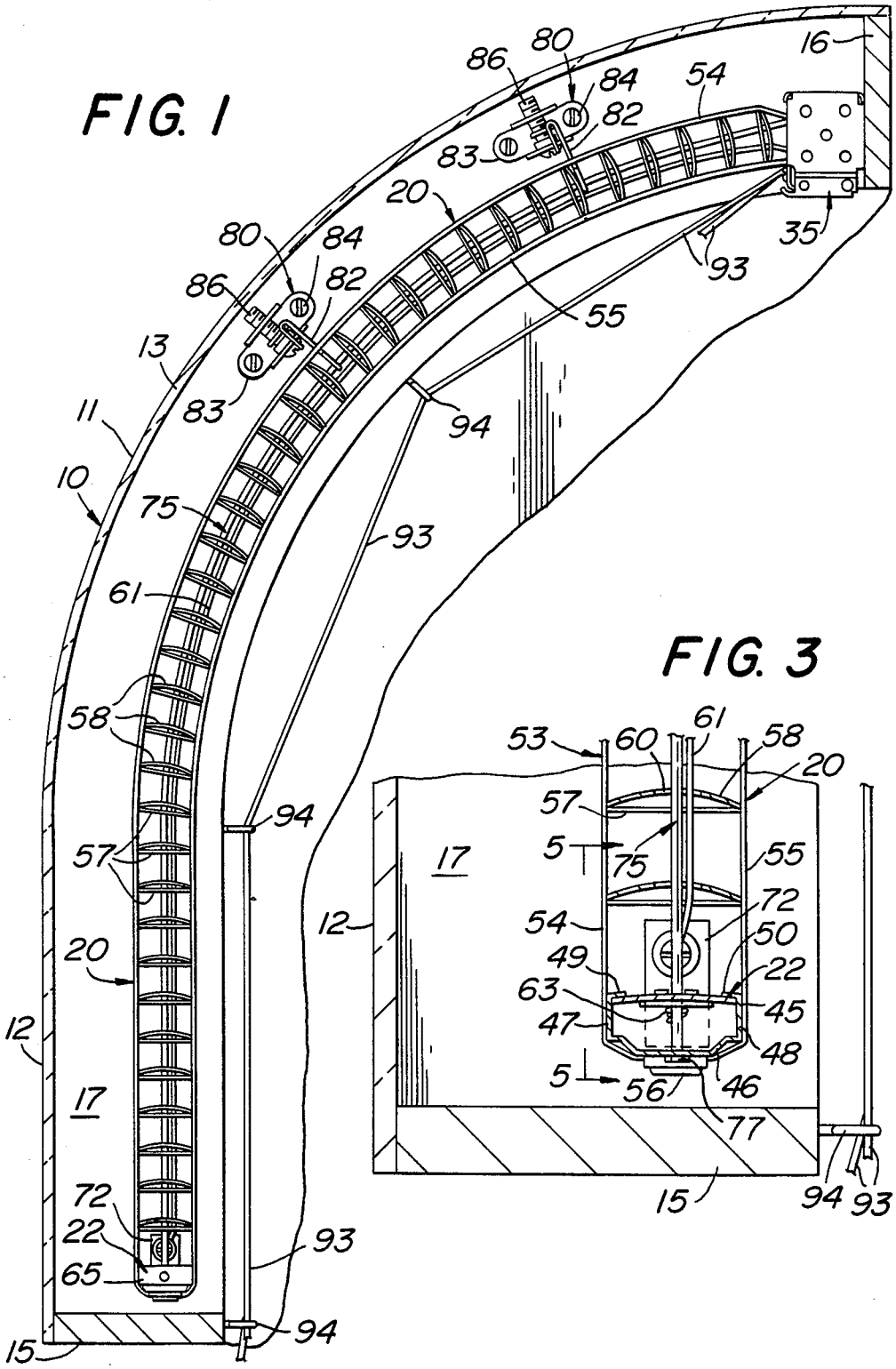
FIG. 1 is a side elevational view showing a venetian blind of the present invention installed in arcuately conforming relation with curved glazing.
FIG. 3 is a partial sectional elevational view showing the lower portion of the blind of FIG. 1.

Referring now more particularly to the drawings, and specifically to FIG. 1 thereof, a building construction is there generally designated 10, including arcuate glazing or glass 11 which, in the illustrated embodiment, may include a vertical lower portion 12 which merges at its upper end smoothly into a circular or cylindrical quadrant or upper portion 13. The glass or glazing 11 may be secured at its lower extremity to a generally horizontal frame member or sill 15, and may be secured at its upper end to a generally horizontal frame member or lintel 16. The sill 15 and lintel 16 extend horizontally between side pieces or jams, as at 17 and 18, see FIGS. 4 and 5. The window or glazing may also extend laterally between the side pieces or jams 17 and 18. Of course, the building construction may vary, as desired, and is shown herein for purposes of illustration only, without limiting intent.

Figure 2:
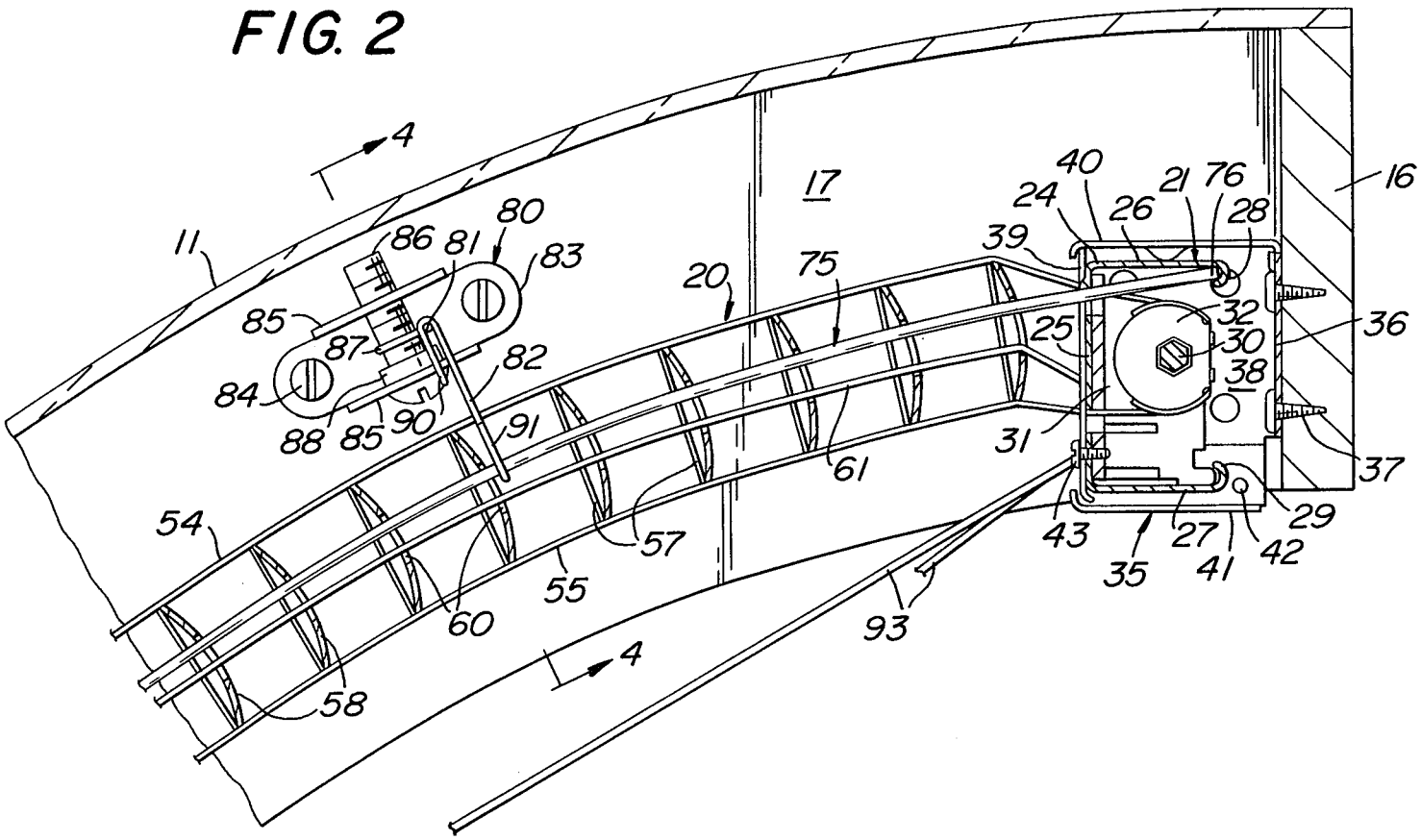
FIG. 2 is a partial sectional elevational view showing the upper portion of the blind of FIG. 1.
Figures 4, 5:
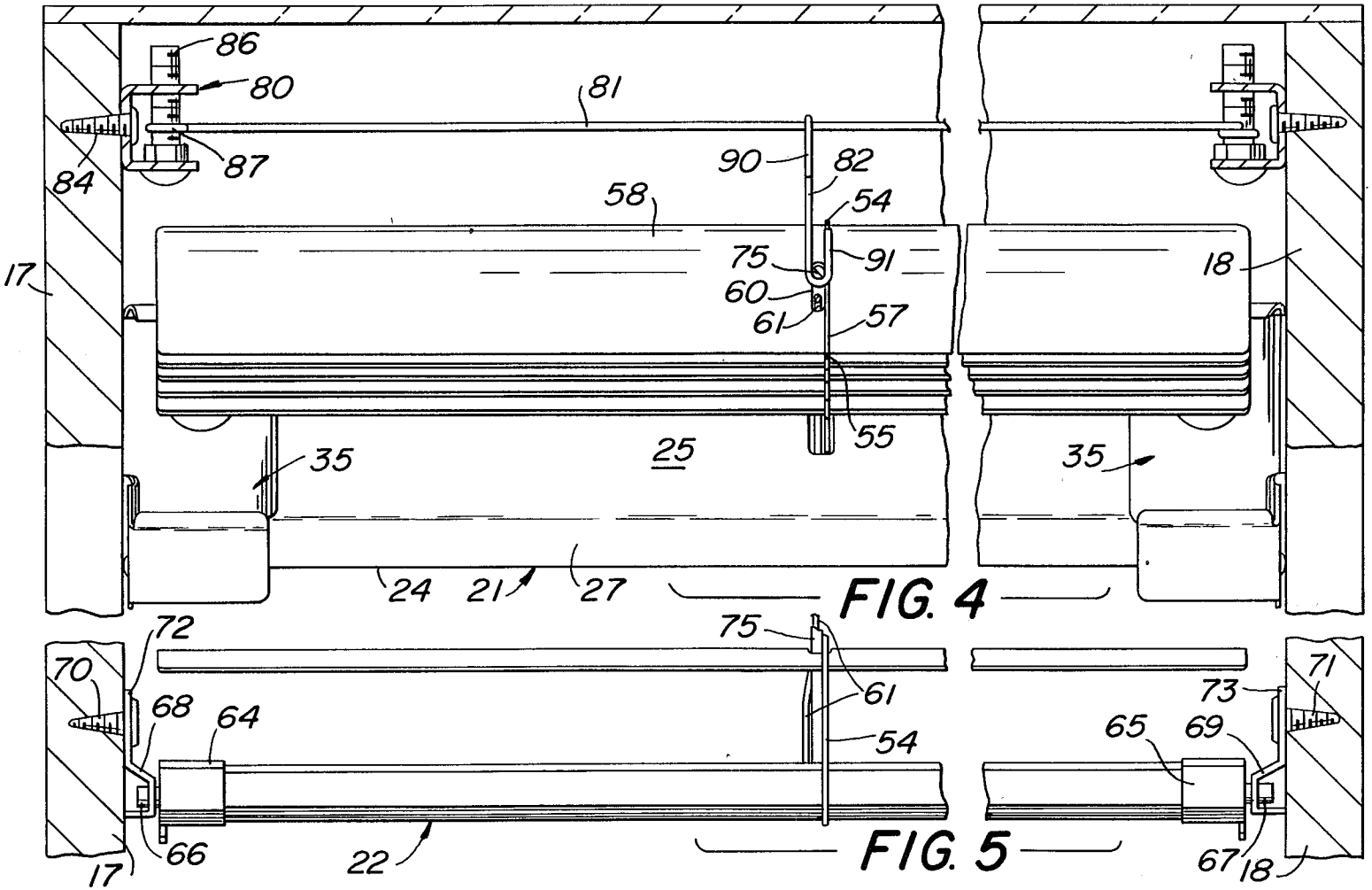
FIG. 4 is a transverse sectional view taken generally along the line 4—4 of FIG. 2, partly broken away to conserve drawing space.
FIG. 5 is a partial elevational view taken generally along the line 5—5 of FIG. 3, also partly broken away.

The venetian blind of the present invention is generally designated 20 and may include a pair of upper and lower end rails 21 and 22, respectively, the former being seen in FIGS. 2 and 4, and the latter being seen in FIGS. 1, 3 and 5.

The upper head rail 21 may be composed of an elongate channel 24 having a bottom wall or web 25 and parallel side walls or flanges 26 and 27 extending along opposite sides of the web. The side walls or flanges 26 and 27 are provided along their edges remote from the bottom wall 25 with inturned edge portions or lips 28 and 29.

An elongate, non-circular tilt rod 30 extends longitudinally within the channel 24 of head rail 21, and is rotatably supported in a pair of tilt rod bearings or journals 31, which carry a pair of ladder connectors or drums 32.

At opposite ends of the head rail 21 are a pair of head rail mounting brackets 35, each of which may include a back wall 36 secured fast to the lintel 16, as by fasteners 37, a side wall 38 extending rigidly from the back wall 36 outward beyond the adjacent end of the head rail 21, and a front wall 39 extending rigidly inwardly from the side wall 38 in facing spaced relation with the back wall 36. One end wall 40 may extend rigidly from the side wall 38 between the back wall 36 and front wall 39; and, another end wall 41 may be pivoted to the side wall 38, as by a rivet 42. Thus, the lower side wall 41 is swingable from the closed position illustrated in FIG. 2 downwardly to an open position for upward entry of the head rail 21 into the bracket 35, after which the lower side wall may be swung to a snap retained closed position, as illustrated. Preferably the head rail 21 is secured fast in the bracket 35 by suitable securing means, such as a threaded fastener or screw 43 extending through the front bracket wall 39 and threadedly into the generally vertically disposed web 25 of the head rail channel 24. In the illustrated embodiment, the channel web 35 is disposed vertically and the channel side walls or flanges 26 and 27 are disposed horizontally, but this may be otherwise, according to the installation required.

The lower end rail 22 is parallel to the upper end rail 21, and may be composed of an elongate channel like part 45 (see FIG. 3), having a longitudinal bottom wall or web 46, and upstanding side walls or flanges 47 and 48 extending, respectively, along the outer and inner edges of the bottom wall. Along the upper edges of side walls 47 and 48 are inturned lips 49 and 50; and, a top wall or closure sheet 51 extends across the upper side of the channel 45 beneath the lips 49 and 50.

At least a pair of ladder-like slat supports or ladders 53 may extend between the upper and lower end rails 21 and 22. In particular, each ladder 53 may be entirely fabricated of flexible elongate filament or cord, including a pair of elongate side pieces or tapes 54 and 55, and a plurality of cross pieces or rungs 57 extending between the side pieces. The upper ends of ladder side pieces 54 and 55 extend freely through the channel web 25 of upper end rail 21, into the interior thereof and are respectively wound in opposite directions about and secured to the adjacent ladder drum 32. The lower end portions of ladder side pieces 54 and 55 may depend on opposite sides of the lower end rail 22, being secured thereto by suitable means, such as a tape retainer insert or plug 56 press fit through a suitable opening in the lower channel web 46.

By any suitable tilt rod rotating means, say conventional pulley means or worm gear means, or other, the tilt rod 30 may be caused to rotate in a selected direction, shifting the ladder tapes or side pieces 54 in opposite directions, and causing rotation of the lower end rail 22. Supported on the several rungs or ladder cross pieces 57 are a plurality of generally parallel, transversely arcuate slats 58 extending in parallelism with the upper and lower end rails 21 and 22. Further, upon rotation of the tilt rod 30 and the lower end rail 22, and shifting of the ladder side pieces 54 and 55, the slats 58 are caused to tilt in unison to a desired angle.

The several slats are each provided with transverse slots, as at 60, and a flexible lift cord 61 may extend through all of the slat slots 60 having its upper end anchored in the head rail 21, and having its lower end extending through an apertured fitting or plug 62 extending through the bottom rail closure plate 51. The lift cord 61 may be knotted, as at 63 for securement in the bottom rail 22.

The ends of the bottom rail may be enclosed by end closures or caps 64 and 65, see FIG. 5. The end closures or caps 64 and 65 may snugly conformably embrace respective ends of the bottom rail 22; and the end caps are provided outstanding from their end walls with projections or pintles 66 and 67, which are in substantial alignment with each other. The bottom rail 22 is mounted by means of the pintles 66 and 67 in mounting brackets 68 and 69, respectively affixed to adjacent window sides 17 and 18, as by fasteners 70 and 71.

More specifically, the brackets 68 and 69 each include a securement portion, as at 72 and 73, respectively, which is fastened to its adjacent window jam, and a lower, inwardly offset portion rotatably receiving the adjacent pintle 66, 67. That is, an inwardly offset bracket portion 72 of bracket 68 rotatably receives pintle 66, while an inwardly offset portion 73 of bracket 69 rotatably receives its adjacent pintle 67.

In this manner the lower end rail 22 is held in parallel spaced relation with respect to the upper end rail 21, while being mounted for rotation about a longitudinal axis by rotation of the ladder drum 32 and shifting of the ladder side pieces 54 and 55.

An elongate, stiff resilient stay member or compression wire is generally designated 75 and extends through all of the slats 58, specifically extending through all of the aligned slat slots 60, best seen in FIG. 2. The upper end of the stay member or compression wire 75, as at 76, enters the head rail 21 through a tape guide opening and is retained in end engagement with the upper channel wall lip 28. The lower end of the stay member or compression wire passes from the lowermost slat 58 through the bottom rail fitting or lift cord retainer 62 into the bottom rail 22, as at 77, for end engagement in the bottom rail. As best seen in FIG. 3, the compression wire or stay member 75 enters the bottom rail 22, passing the lift cord knot 63 and may be in end engagement with the ladder side piece retainer or fitting 56. Thus, the stay member 75 is effectively retained endwise in the opposite end rails 21 and 22, and retained laterally in the several slats 58.

The blind 20 will assume its arcuate configuration by suitably supporting the stay member 75 in an arcuate configuration. Support means for this purpose is generally designated 80. A pair of such supports 80 are shown in FIG. 1, but being substantially identical so that only a single support means will be described in detail. Similarly, a plurality of ladders 53 may be provided, together with stay members 75, at spaced locations along the slats 58.

The support means 80 may include a tension tie member or wire 81 extending generally horizontally between window side piece 17 and 18, see FIG. 4, and at spaced locations between the upper and lower end rails 21 and 22. Thus, the tension or tie member 81 extends in parallelism with the slats 58, and between the slats and the window glass 11. A connector or clip 82 extends between each of the compression or stay members 75 and the tension or tie member 81, in order to support the stay members in a desired arcuate configuration with their ends 76 and 77 effectively retained in the head rail 21 and bottom rail 22. In this manner the stay members 75 are caused to assume curves in planes normal to the venetian blind.

The tension or tie member 81 is secured at its opposite ends by fixtures 83 anchored fast to the window sides 17 and 18, as by fasteners 84. The fixture 83 includes parallel flanges 85 outstanding from the window side member 18; and, a threaded member or bolt 86 extends through and is rotatably supported by the flanges 85. The bolt 86 may extend generally radially of the desired arc of the venetian blind. The adjacent end of tie member 81 is anchored to and wound about the associated bolt 86, as at 87 to tighten and straighten the tie member 81. The bolt may be locked in a desired position by a lock nut 88 against one flange 85. One or both ends of the tension wire 81 may be mounted for tightening, as desired.

The connectors or clips 82 may each consist of a wire having its opposite ends doubled back, as at 90 and 91. The doubled end portions or hooks 90 and 91 are located in planes spaced 90 degrees apart for respective engagement over the tie wire 81 and compression wire 75, which are located in planes spaced 90 degrees apart. The length of connectors 82 may vary across the width of the blind, if desired; and, the wire or wires 81 may be tightened or loosened to achieve the curvature desired in the blind.

While the cord 61 does not perform its conventional lifting function in the instant blind, it does serve to maintain the slats assembled with the remaining components prior to insertion of the stay members.

While a tilt operator of the wand type may be employed, it is usually preferred in the instant invention to utilize a cord operator, as at 93, which may be led by guide eyes 94 to a lower position adjacent the window sill. Of course, the blind may be of any desired width by providing additional compression wires or stay members 75 at spaced locations along the width, as well as additional connectors 82 for the additional stay members. Also, the vertical extent or extent along the arc may be as desired, possibly necessitating more or less of the support means 80 to provide a desired number of tension wires 81 at spaced locations along the arc. Further, the tension of the wires 81 may be varied to adjust the curvature of the blind, as desired.

From the foregoing it is seen that the present invention provides a nonplanar or arcuate blind construction which is extremely simple to manufacture, assemble and install, and permits of selective opening and closing of the blind for achieving desired privacy, light and ventilation.

Although the present invention has been described in some detail by way of illustration and example for purposes of clarity of understanding, it is understood that certain changes and modifications may be made within the spirit of the invention.

What is claimed is:

1. A nonplanar blind comprising a pair of end rails for location in parallel spaced relation, mounting means mounting said end rails in said parallel spaced relation and adapted for fastening to a building construction, flexible ladders extending between said end rails, a plurality of slats extending through and supported by said ladders, an elongate stay means extending through said slats and having opposite ends extending respectively into and terminating in endwise bearing engagement with said rails, said stay means being arcuate in a plane transverse to said rails for maintaining said slats in a nonplanar relation defined by said stay means.

2. A nonplanar blind according to claim 1, said mounting means comprising a pair of mounting brackets at opposite ends of each end rail for fastening to a building construction, said stay means comprising at least one stiff resilient elongate element extending through said slats under longitudinal compression maintained by said endwise bearing engagement with said rails, and support means in holding engagement with an intermediate region of said elongate element other than the midpoint thereof and adapted for fastening to the building construction to maintain a specified arcuate relationship of said elongate element.

3. A nonplanar blind according to claim 2, said elongate element having its opposite ends in abutting engagement in respective end rails.

4. A nonplanar blind comprising a pair of end rails for location in parallel spaced relation, mounting means mounting said rails in said parallel spaced relation and adapted for fastening to a building construction, flexible ladders extending between said end rails, a plurality of slats extending through and supported by said ladders, an elongate stay means extending through said slats and having opposite ends connected to said rails, said stay means being arcuate in a plane transverse to said rails for maintaining said slats in a nonplanar relation defined by said stay means, said stay means comprising at least one stiff resilient elongate element extending through said slats and having its opposite ends in respective end rails, and support means in holding engagement with an intermediate region of said elongate element and adapted for fastening to the building construction to maintain the arcuate relationship of said elongate element, said support means comprising an elongate tie member extending generally parallel to said slats intermediate said end rails, fixture means for securing said tie member to a building construction, and a connector extending between said tie member and an intermediate region of said stay means to aid in maintaining the arcuate condition thereof.

5. A nonplanar blind according to claim 4, said elongate tie member being on the convex side of said blind, and said connector being in tension between said tie member and stay means.

6. A nonplanar blind according to claim 5, said tie member comprising a wire, and said fixture means comprising a rotary pin for winding and exerting tension on said wire.

7. A nonplanar blind according to claim 5, said connector comprising a clip extending between and having opposite ends engageable about said tie member and stay means.

8. A nonplanar blind according to claim 4, said elongate stay means having opposite ends extending respectively into and terminating in endwise bearing engagement with said rails.

9. A nonplanar blind according to claim 8, said elongate element extending through said slats under longitudinal compression maintained by said endwise bearing engagement with said rails, and said connecter extending between said tie member and an intermediate region of said stay means spaced from the midpoint thereof to aid in maintaining a specific arcuate condition thereof.

* * * * *